US007442132B2

(12) United States Patent
Nishio

(10) Patent No.: US 7,442,132 B2
(45) Date of Patent: Oct. 28, 2008

(54) GOLF CLUB HEAD

(75) Inventor: Masayoshi Nishio, Kobe (JP)

(73) Assignee: SRI Sports Limited, Kobe (JP)

( * ) Notice: Subject to any disclaimer, the term of this patent is extended or adjusted under 35 U.S.C. 154(b) by 298 days.

(21) Appl. No.: 11/342,575

(22) Filed: Jan. 31, 2006

(65) Prior Publication Data

US 2006/0194644 A1 Aug. 31, 2006

(30) Foreign Application Priority Data

Feb. 25, 2005 (JP) ..... 2005-051104

(51) Int. Cl.
*A63B 53/04* (2006.01)

(52) U.S. Cl. ..... 473/342; 473/346; 473/350

(58) Field of Classification Search ..... None
See application file for complete search history.

(56) References Cited

U.S. PATENT DOCUMENTS

| | | | | |
|---|---|---|---|---|
| 2,087,685 | A * | 7/1937 | Hackney | 473/349 |
| 5,362,055 | A * | 11/1994 | Rennie | 473/342 |
| 5,497,993 | A * | 3/1996 | Shan | 473/329 |
| 5,595,552 | A * | 1/1997 | Wright et al. | 473/332 |
| 5,669,829 | A * | 9/1997 | Lin | 473/346 |
| 5,718,641 | A * | 2/1998 | Lin | 473/224 |
| 5,993,331 | A * | 11/1999 | Shieh | 473/342 |
| 6,379,262 | B1 * | 4/2002 | Boone | 473/324 |
| 6,605,007 | B1 * | 8/2003 | Bissonnette et al. | 473/329 |
| 6,840,872 | B2 * | 1/2005 | Yoneyama | 473/346 |
| 6,926,618 | B2 * | 8/2005 | Sanchez et al. | 473/329 |
| 7,101,289 | B2 * | 9/2006 | Gibbs et al. | 473/329 |
| 7,137,907 | B2 * | 11/2006 | Gibbs et al. | 473/329 |
| 7,169,062 | B2 * | 1/2007 | Chen | 473/342 |
| 7,258,626 | B2 * | 8/2007 | Gibbs et al. | 473/329 |
| 2003/0144079 | A1 * | 7/2003 | Yoneyama | 473/346 |
| 2004/0132544 | A1 * | 7/2004 | Doi | 473/345 |

FOREIGN PATENT DOCUMENTS

| | | | |
|---|---|---|---|
| JP | 2004-533894 | A | 11/2004 |
| WO | WO-03/004108 | A1 | 1/2003 |

* cited by examiner

*Primary Examiner*—Gene Kim
*Assistant Examiner*—Alvin A Hunter
(74) *Attorney, Agent, or Firm*—Birch, Stewart, Kolasch & Birch, LLP

(57) ABSTRACT

A golf club head includes a face including a bulge formed at the center of a backside thereof and having a thickness of 2.0 or more times the thickness of the thinnest part, and a plurality of ribs extended from the bulge toward a circumference of the face. Six or more ribs are provided as the plural ribs and an angle θ(°) formed between extension directions of a respective pair of adjoining ribs is less than 90°. The maximum thickness of the bulge is not more than 3.5 times the thickness of the thinnest part.

13 Claims, 11 Drawing Sheets

GOLF CLUB HEAD

BACKGROUND OF THE INVENTION

The present invention relates to a golf club head.

In recent years, the golf club heads have achieved weight reduction by reducing face thickness. In addition, the golf club heads are also increased in the restitution coefficient at the face thereby achieving enhanced carry performance for carrying the ball over a greater distance.

In general, the golf club head exhibits the maximum value of restitution coefficient at the face center, the restitution coefficient progressively being decreased from the face center toward a circumference of the face.

It has been a conventional practice to increase the restitution coefficient at the face center, so as to maintain relatively high restitution coefficients at the other portions than the face center. Even when an impact point is deviated from the face center, therefore, the head is not extremely lowered in the carry performance. However, a worldwide trend is toward prohibition of the use of golf clubs having high restitution coefficients. For instance, the US Golf Association (U.S.G.A.) and the Royal and Ancient Golf Club of St. Andrews (R&A) specify the upper limit of the restitution coefficient of the golf club heads. This makes it difficult to maintain the high restitution coefficients at the other portions than the face center by increasing the restitution coefficient at the face center, as practiced in the conventional heads. Hence, a fear exists that the golf club head may be extremely lowered in the carry performance when the impact point is deviated from the face center.

Because of the above situations, there is a demand for a golf club head in which relatively high restitution coefficients are evenly distributed in a wide area or from the face center toward the circumference of the face. Such a face design lessens the drop of restitution coefficient even when the impact point is deviated from the face center. Hence, the face design can ensure a consistently high carry performance and besides, clear the restriction on the restitution coefficient.

In this connection, a proposal has been made to expand a sweet spot by forming a rib on a face backside in an annular shape about the face center, whereby the face may be increased in an area having a relatively high restitution coefficient (see, for example, Japanese Unexamined Patent Publication No. 2004-533894 (FIG. 1 and FIG. 2)).

However, even the golf club head disclosed in the above patent publication cannot achieve the consistent carry performance because there may be a case where the area having the relatively high restitution coefficient is not large enough, and because the other face portions than the above area suffer a significant drop of restitution coefficient. On this account, there has been a strong demand for a technique which is applied to the golf club head for permitting the head face to attain the high restitution coefficient evenly distributed across a wide area such that the drop of restitution coefficient may be lessened even when the ball impact point is deviated from the face center.

SUMMARY OF THE INVENTION

In view of the foregoing, the invention has been accomplished and has an object to provide a golf club head which is adapted to lessen the drop of restitution coefficient even when the ball impact point is deviated from the face center.

The present inventor has devoted himself to an intensive study to develop a golf club head having a face adapted to attain a higher restitution coefficient distributed more evenly across a wide area. In the development process, the present inventor has conducted a variety of tests, focusing attention to a thickness distribution on the face backside. As a result, the present inventor discovered that the face backside may be formed with a thick bulge at the center thereof and may also be formed with predetermined ribs, whereby the face may attain the relatively high restitution coefficients across the wide area and may have a more even distribution of restitution coefficients than the conventional head faces. Thus is accomplished the invention.

According to the present invention, a golf club head comprises a face which includes a bulge formed at the center of a backside thereof and having a thickness of 2.0 or more times the thickness of the thinnest part, and a plurality of ribs extended from the bulge toward circumference of the face, wherein six or more ribs are provided as the plural ribs and an angle θ(°) formed between extension directions of a respective pair of adjoining ribs is less than 90°, and wherein the maximum thickness of the bulge is not more than 3.5 times the thickness of the thinnest part.

According to the above constitution, the face is locally increased in rigidity at its center by forming the bulge. Hence, an effect to prevent the restitution coefficient from being locally increased at the face center (hereinafter, also referred to as "local restitution-coefficient curbing effect") may be obtained. Therefore, the change of restitution coefficient may be smoothened from the face center toward the face circumference, so that the restitution coefficients may be relatively evenly distributed across the overall face. What is more, the other portions than the bulge are reinforced with the plural ribs thereby allowing the face to be formed relatively thin. Thus, the face as a whole may be improved in the restitution performance.

The ribs are laid from the face center toward the circumference of the face, whereby stress exerted on the face may be more evenly dispersed without excessively increasing the face rigidity. The reason for defining the number of ribs to be six or more is that if less than six ribs are disposed, rib-free regions are so large that the face tends to suffer insufficient strength at the rib-free regions. The reason for defining the above angle θ to be less than 90° is that if there is a region containing the aforesaid angle θ of 90° or more, the face tends to suffer the insufficient strength at the region.

In a case where the thickness of the bulge is less than 2.0 times the thickness of the thinnest part, the face cannot attain a required rigidity at the center thereof, thus failing to fully exhibit the local restitution-coefficient curbing effect. In a case where the maximum thickness of the bulge is more than 3.5 times the thickness of the thinnest part, the bulge has an excessive thickness and hence, the face is excessively lowered in the restitution performance.

According to the above golf club head, it is preferred that the bulge is disposed at place including a sweet spot and has an area percentage of 2 to 5% based on the overall area of the face backside.

In this case, the increase of restitution coefficient at the sweet spot is curbed although the restitution coefficient at the sweet spot, in particular, is apt to increase. Hence, the face may be further enhanced in an effect to equalize the restitution coefficient distribution. If the aforesaid area percentage of the bulge is less than 2%, the restitution coefficient at the face center may be increased too much. Consequently, the effect to equalize the restitution coefficient distribution may be decreased. If the area percentage of the bulge exceeds 5%, the rigidity at the face center is excessively increased so that the overall face may be decreased in the restitution coefficient.

According to the above golf club head, it is preferred that a cross-sectional area of the rib is in the range of 2.0 to 10.0 $mm^2$. If the cross-sectional area of the rib is less than 2.0 $mm^2$, the face is more prone to failure because of in sufficient face strength. If the cross-sectional area of the rib exceeds 10.0 $mm^2$, the face rigidity is excessively increased so that the face is lowered in the restitution performance.

The cross-sectional area of the rib is defined as follows. Provided that a position A is defined to be spaced away from a longitudinal center position of the rib toward one end thereof by a distance of 40% of the overall rib length (which means hereinafter the overall longitudinal length of the rib) and that a position B is defined to be spaced away from the longitudinal center position of the rib toward the other end thereof by a distance of 40% of the overall rib length, the cross-sectional area of the rib is defined as a mean value of the cross-sectional areas as determined at longitudinal positions between the position A and the position B.

It is further preferred that a width of the rib is in the range of 3 to 14 mm whereas a height of the rib is in the range of 0.3 to 1.5 mm. If the rib width is less than 3 mm, the stress concentrates on the rib having a relatively small width so that the rib is more likely to sustain failure at its edge. If the rib width exceeds 14 mm, the face is excessively increased in the rigidity so that the face tends to be lowered in the restitution performance. If the rib height is less than 0.3 mm, the rib provides a decreased face reinforcing effect. If the rib height exceeds 1.5 mm, the stress tends to concentrate on the rib.

According to the above golf club head, it is preferred that a thickness of the face is in the range of 0.5 to 6.2 mm. If the face thickness is less than 0.5 mm, the face strength tends to fall short. If the face thickness exceeds 6.2 mm, the face is so excessively increased in the rigidity as to be lowered in the restitution performance.

DETAILED DESCRIPTION

Figure 1:
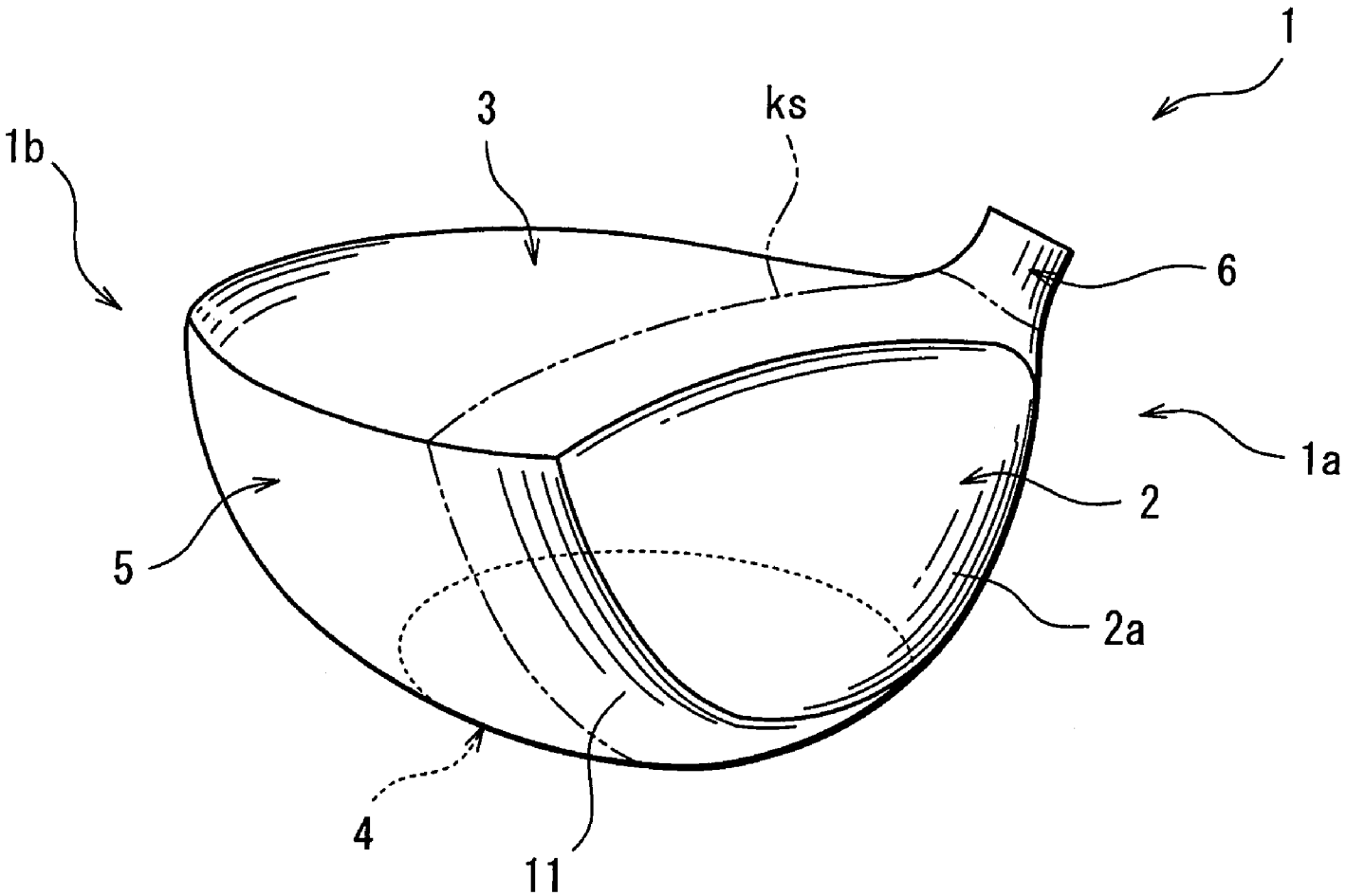
FIG. 1 is a perspective view showing the whole body of a golf club head according to one embodiment of the present invention.

Preferred embodiments of the present invention will hereinbelow be described with reference to the accompanying drawings. FIG. 1 is a perspective view showing the whole body of a golf club head 1 (hereinafter, also referred to simply as "head 1") according to one embodiment of the present invention. This head 1 is a golf club head of a so-called wood type and includes: a face portion 2 for striking a ball; a crown portion 3 constituting a top surface of the head 1 as extending from an upper edge of the face portion 2 toward a rear side of the head; a sole portion 4 constituting a bottom surface of the head 1 as extending from a lower edge of the face portion 2 toward the rear side of the head; a side portion 5 constituting a portion except for the face portion 2 as extended between the crown portion 3 and the sole portion 4; and a hosel portion 6 including a shaft hole (not shown) to which a shaft (not shown) is insertedly bonded.

The head 1 is formed from a metal such as a titanium alloy and has a two-piece structure which includes two members bonded together and the interior of which is hollowed out. In FIG. 1, a phantom line (chain double-dashed line) indicates a boundary line ks between the two members bonded together. The head 1 is formed by bonding together a cup-face 1*a* and a head body 1*b* by welding along the boundary line ks. The cup-face 1*a* is substantially shaped like a cup and includes the overall face portion 2 and a rising portion 11 extending from a circumference of the face portion 2 toward the rear side of the head, thus constituting a front portion of the head 1. The head body 1*b* includes the portions of the head 1 that exclude the cup-face 1*a*, thus constituting a rear portion of the head 1. The rising portion 11 of the cup-face 1*a* defines respective face-side parts of the crown portion 3, the sole portion 4 and the side portion 5. The head body 1*b* defines respective rear-side parts of the crown portion 3, the sole portion 4 and the side portion 5 as well as the hosel portion 6. The whole body of the head 1 is formed from a titanium alloy. The cup-face 1*a* is formed by forging whereas the head body 1*b* is formed by lost wax precision casting.

The present invention does not particularly limit the material of the head 1. For example, a variety of metals, fiber-reinforced plastics and the like are usable. Examples of a preferably usable metal include titanium, titanium alloys, stainless steel alloys, aluminum alloys, magnesium alloys and the like. These metal materials may be used alone or in combination of plural types. Examples of a usable titanium alloy include Ti-6Al-4V, Ti-15V-3Cr-3Al-3Sn, Ti-15Mo-5Zr-3Al, Ti-13V-11Cr-3Al and the like. Beta titanium alloys having high strength, in particular, may favorably be used for forming the face portion 2. Examples of a usable fiber-reinforced plastic include plastics reinforced with carbon fiber. The face portion 2 may employ a rolled material or a forged material so as to ensure strength, whereas the other portions may employ cast articles having high design freedom. Then, these portions may be unified by welding. This method is preferred from a viewpoint of achieving both the high strength and the high degree of freedom of configuration design. On the other hand, a plastic reinforced with carbon fiber may be used for forming a part or the whole body of the crown portion 3, while the other portions may be formed by forging metal. This method is preferred because it is easy to set a low gravity center.

Figure 2:
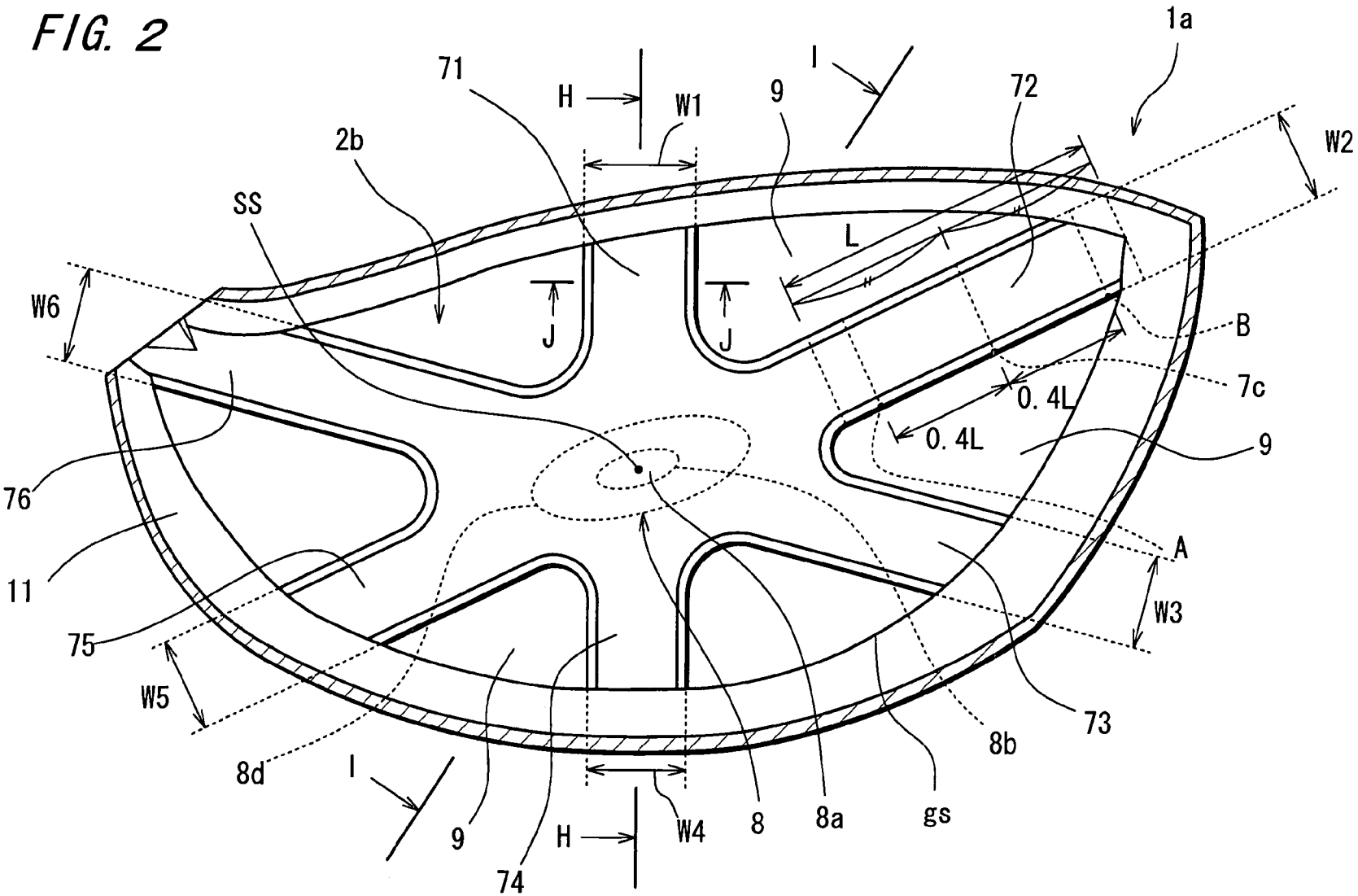
FIG. 2 is a plan view of a cup-face in FIG. 1 as viewed from place opposite a face backside.

An outside surface of the face portion 2 of the cup-face 1*a* defines a face surface 2*a* which contacts a ball at impact with the ball. FIG. 2 is a plan view of the cup-face 1*a* as viewed from a backside of the face surface 2*a*. A hatched area in FIG. 2 represents an end face of the cup-face 1*a*. The cup-face is welded to the aforementioned head body 1*b* at the end face.

As shown in FIG. 2, a face backside 2*b* is provided with six ribs 71 to 76 for reinforcing the face portion 2, the ribs being extended from a face center toward a face circumference. These ribs 71 to 76 are formed in a greater thickness than that of a non-rib portion 9 formed with no rib. The ribs are radially arranged about the face center and are each extended from the face center to an outside circumference gs of the face (an outside edge of the face backside 2*b*). In FIG. 2, an area defined between the outside circumference gs of the face and the end face (hatched area) of the cup-face 1*a* represents (an inner side of) the aforementioned rising portion 11 of the cup-face 1*a*.

Figure 3A:
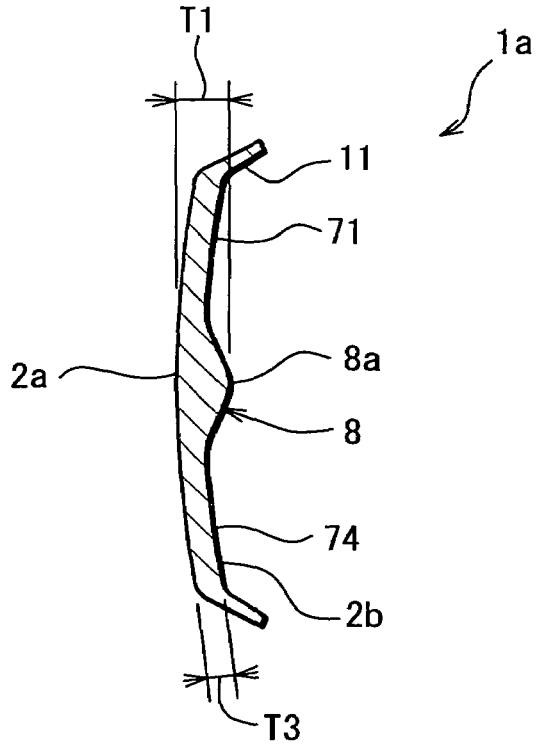
FIG. 3A is a sectional view taken along the line H-H in FIG. 2, for showing a cross-section including a face center and extending along ribs.
Figure 3B:
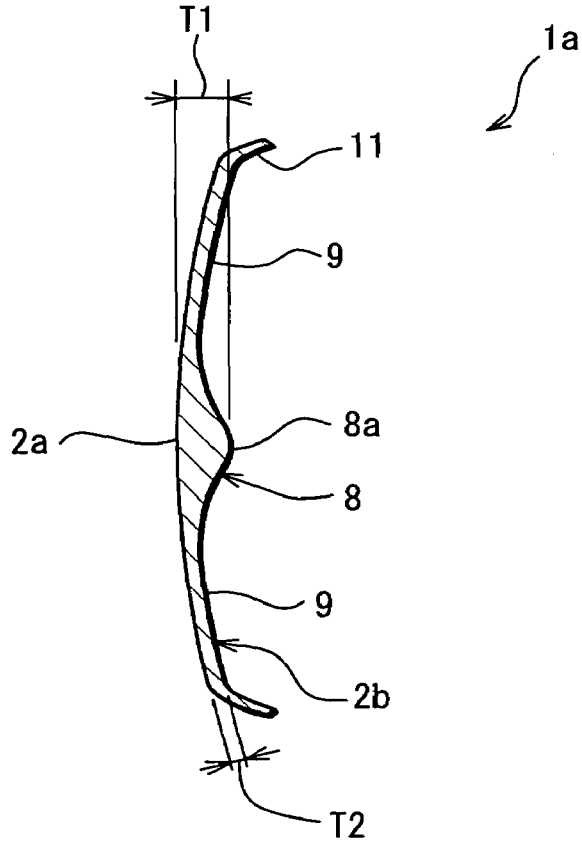
FIG. 3B is a sectional view taken along the line I-I in FIG. 2, for showing a cross-section including a non-rib portion formed with no rib, and the face center.

FIG. 3A is a sectional view taken along the line H-H in FIG. 2, for showing a cross-section including the face center and extending along the ribs 71 and 74. FIG. 3B is a sectional view taken along the line I-I in FIG. 2, for showing a cross-section including the non-rib portion 9 formed with no rib, and the face center. As shown in the figures, the face backside 2*b* is centrally formed with a bulge 8, which protrudes inwardly of the head 1. In other words, the individual ribs 71 to 76 are extended from the bulge 8, formed at the center of the face backside 2*b*, toward the face circumference.

The bulge 8 is formed in a manner that a thickness T1 at its crest 8*a* is substantially at a constant value in an area defined by a broken line 8*b* (FIG. 2) and is greater than a thickness T3 of each of the ribs 71 to 76. That is, the crest 8*a* of the bulge 8 has the greatest thickness in the face backside 2*b*. On the other hand, the non-rib portion 9 is formed in the smallest thickness.

The thickness means herein a dimension defined between the face surface 2*a* and the face backside 2*b* with respect to the cross-section of the face portion 2.

In the face portion 2, the bulge 8 is a portion which is located centrally of the face portion 2 and is so formed as to have a thickness of 2.0 or more times the thickness T2 of the non-rib portion 9 having the smallest thickness in the face portion. The thickness T1 at the crest 8*a* of the bulge 8 (the maximum thickness of the bulge 8) is defined to be not more than 3.5 times the thickness T2.

In a case where the thickness of the bulge 8 is less than 2.0 times the thickness T2, the face portion 2 cannot attain a required rigidity at the center thereof and hence, cannot fully exhibit the local restitution-coefficient curbing effect. In a case where the thickness T1 is more than 3.5 times the thickness T2, the bulge 8 has an excessive thickness and hence, the face is excessively lowered in the restitution performance.

Figure 4:
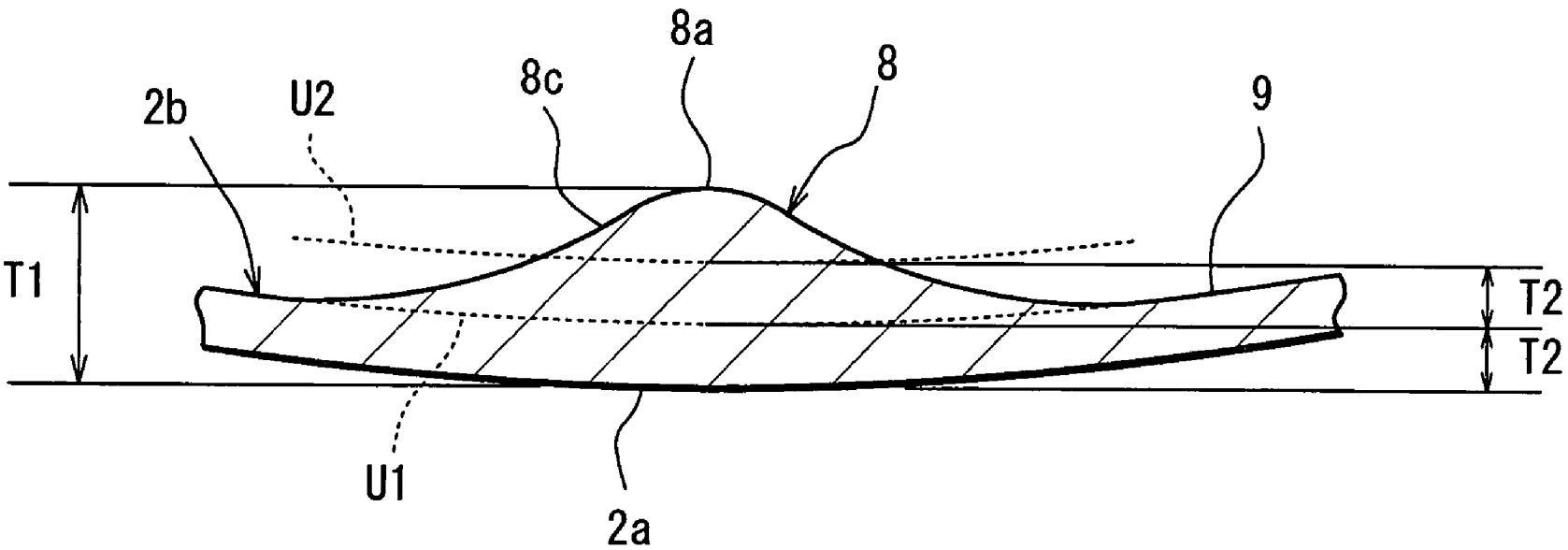
FIG. 4 is an enlarged view showing a bulge in FIG. 3B.

FIG. 4 is an enlarged view showing the bulge 8 in FIG. 3B. The following description is made on a range of the bulge 8 as seen in the cross-section of the face portion 2. In FIG. 4, a broken line U1 is a phantom line indicating a range of a portion under the bulge 8, which is as thick as the thickness T2 of the non-rib portion 9, as determined based on the face surface 2*a*. A broken line U2 is a phantom line indicating a range of a portion which is 2.0 times as thick as the thickness T2 of the non-rib portion 9, as determined based on the face surface 2*a*.

As mentioned supra, the bulge 8 is a portion having the thickness of 2.0 or more times the thickness of the non-rib portion 9. In other words, a portion of a thickness less than 2.0 times the thickness of the thickness T2 of the non-rib portion 9 does not constitute the bulge 8. That is, the range of the bulge 8 as seen in the cross-section thereof is defined as a region enclosed by the broken line U2 and a contour line 8*c* of the bulge 8.

A bottom of the bulge 8 is defined by the broken line U2. In a face view of the face backside 2*b*, the bottom of the bulge 8 or the range of the bulge 8 with respect to the face backside 2*b* is defined by a broken line 8*d* (FIG. 2) indicating intersection of a phantom plane including the broken line U2 plotting the constant thickness of twice the thickness T2 against the overall thickness of the face portion, and the actual face backside 2*b*.

As shown in FIG. 2, a sweet spot SS of the golf club head 1 is located within the range of the bulge 8 enclosed by the broken line 8*d*. Thus, the bulge 8 is so located as to contain the sweet spot SS therein. An area of the range enclosed by the broken line 8*d* or the area of the bulge 8 with respect to the face backside 2*b* is defined to range from 2 to 5% based on the overall area of the face backside 2*b*.

Figure 5:
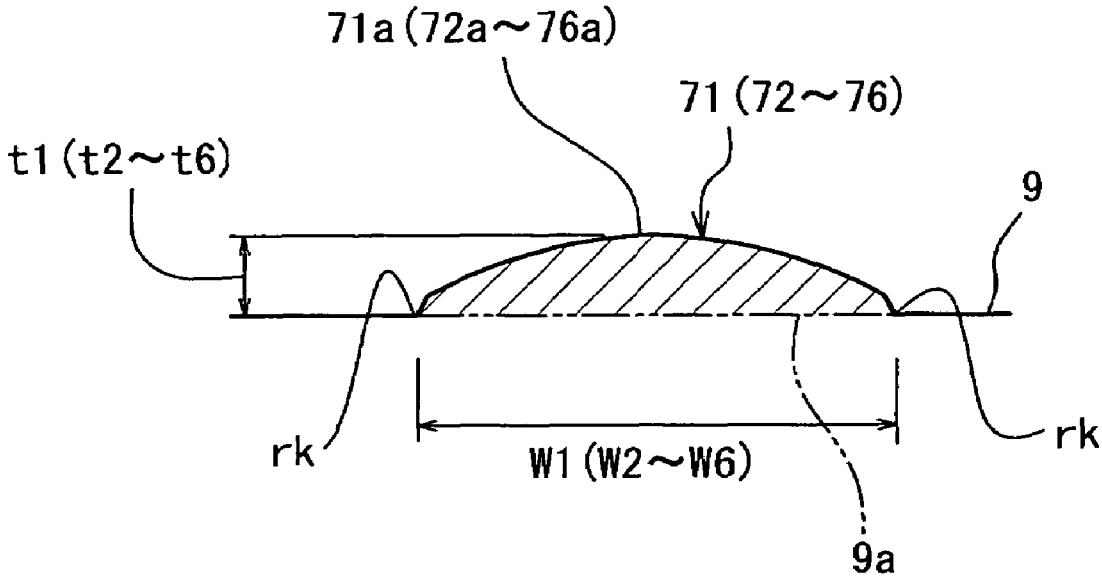
FIG. 5 is a sectional view of a rib taken along the line J-J in FIG. 2.

Next, a specific description is made on the ribs 71 to 76 by way of example of the rib 71. FIG. 5 is a sectional view of the rib 71 taken along the line J-J in FIG. 2. As shown in the figure, the rib 71 is formed in a configuration which defines a smooth curve line as protruded inwardly of the head 1. The rib 71 has a height relative to the non-rib portion 9 progressively decreased from a widthwise center thereof toward widthwise opposite sides thereof and decreased nearly to zero at the opposite sides thereof. The sectional shape of the rib defines the smooth curve so as to eliminate an acutely angled part in the conventional ribs with rectangular cross-section. This configuration provides more even diffusion of stress such as to allow a rib of a smaller volume to achieve a higher face reinforcing effect.

The other ribs 72 to 76 are also configured to have the same sectional shape as that of the rib 71. Each of the ribs 71 to 76 has a fixed sectional specification (cross-sectional area, sectional shape, rib width, rib height) as determined at any positions with respect to the longitudinal length thereof, except for the opposite end portions thereof. Furthermore, the individual ribs 71 to 76 are extended substantially in straight lines.

Individual widths W1 to W6 of the ribs 71 to 76 may preferably be in the range of 3 to 14 mm. If the rib width is less than 3 mm, the stress may be concentrated on a rib having a relatively small width so that the rib may be prone to failure at an edge thereof. Therefore, the rib width may more preferably be 5 mm or more and particularly preferably 7 mm or more. The rib width is defined to be 14 mm or less for the following reason. If the rib width exceeds 14 mm, the face is excessively increased in the rigidity so that the face portion is prone to the decrease of restitution performance. Therefore, the rib width may more preferably be 12 mm or less, even more preferably 10 mm or less and particularly preferably 8 mm or less.

Individual heights t1 to t6 (see FIG. 5) of the ribs 71 to 76 may preferably be in the range of 0.3 to 1.5 mm. The reason for defining the rib height to be 0.3 mm or more is that if the rib height is less than 0.3 mm, the face reinforcing effect provided by the ribs is decreased. Therefore, the rib height may more preferably be 0.5 mm or more and even more preferably 0.7 mm or more. The reason for defining the rib height to be 1.5 mm or less is that if the rib height exceeds 1.5 mm, the stress tends to be concentrated on the ribs. Therefore, the rib height may more preferably be 1.2 mm or less and even more preferably 1.0 mm or less.

A value given by dividing the rib height by the rib width [(rib height)/(rib width)] may preferably be 0.20 or less and more preferably 0.15 or less. If this value is excessive, the stress tends to be concentrated on the rib portion so that the stress diffusion may be reduced. In addition, the rib portion is excessively increased in the rigidity so that the face may be excessively reduced in flexure to be decreased in the restitution performance. However, if the value of [(rib height)/(rib width)] is too small, a region increased in thickness by the rib may become so large that the face may be reduced in the flexure, or the rib may become so low that the face reinforcing effect may be reduced. Therefore, the above value may preferably be 0.05 or more, more preferably 0.08 or more and particularly preferably 0.10 or more.

A cross-sectional area of each of the ribs 71 to 76 (area enclosed by a contour line 71*a* of the rib and an extension line 9*a* of the non-rib portion 9) is defined to range from 2.0 to 10.0 $mm^2$. If the cross-sectional area of each rib is less than 2.0 $mm^2$, the face is prone to failure because of insufficient face strength. Therefore, the cross-sectional area of each rib may preferably be 3.0 $mm^2$ or more and even more preferably 4.0 $mm^2$ or more. If the cross-sectional area exceeds 10.0 $mm^2$, the face may be excessively increased in the rigidity to be decreased in the restitution performance. Therefore, the cross-sectional area of each rib may preferably be 9.0 $mm^2$ or less and even more preferably 8.0 $mm^2$ or less.

While the cross-sectional area of each rib is defined in the foregoing, a more specific description is made by way of example of the rib 72 of the six ribs with reference to FIG. 2. A position A (represented by a reference character "A" in FIG. 2) is defined to be spaced away from a longitudinal center position 7*c* of the overall length L of the rib 72 toward one end thereof by a distance (0.4 L) of 40% of the overall length thereof (which means hereinafter the overall longitudinal length of the rib). Likewise, a position B (represented by a reference character "B" in FIG. 7) is defined to be spaced away from the rib center position 7*c* toward the other end of the rib by a distance (0.4 L) of 40% of the overall length thereof. A mean value of cross-sectional areas determined at longitudinal positions between the position A and the position B is adopted as the cross-sectional area of the rib 72.

It is preferred that a cross-sectional area of the rib as determined at place shifted from the position A toward the rib end and a cross-sectional area thereof as determined at place shifted from the position B toward the rib end are each greater than the above cross-sectional area of the rib (the mean value of the cross-sectional areas determined at longitudinal positions between the position A and the position B). The reason is that the stress tends to concentrate particularly on the rib ends.

As described above, the ribs 71 to 76 are extended from the bulge 8 toward the face circumference. An angle formed between extension directions (indicated by a dot-dash line) of a respective pair of adjoining ones of the ribs 71 to 76 is defined to be less than 90°.

Figure 6:
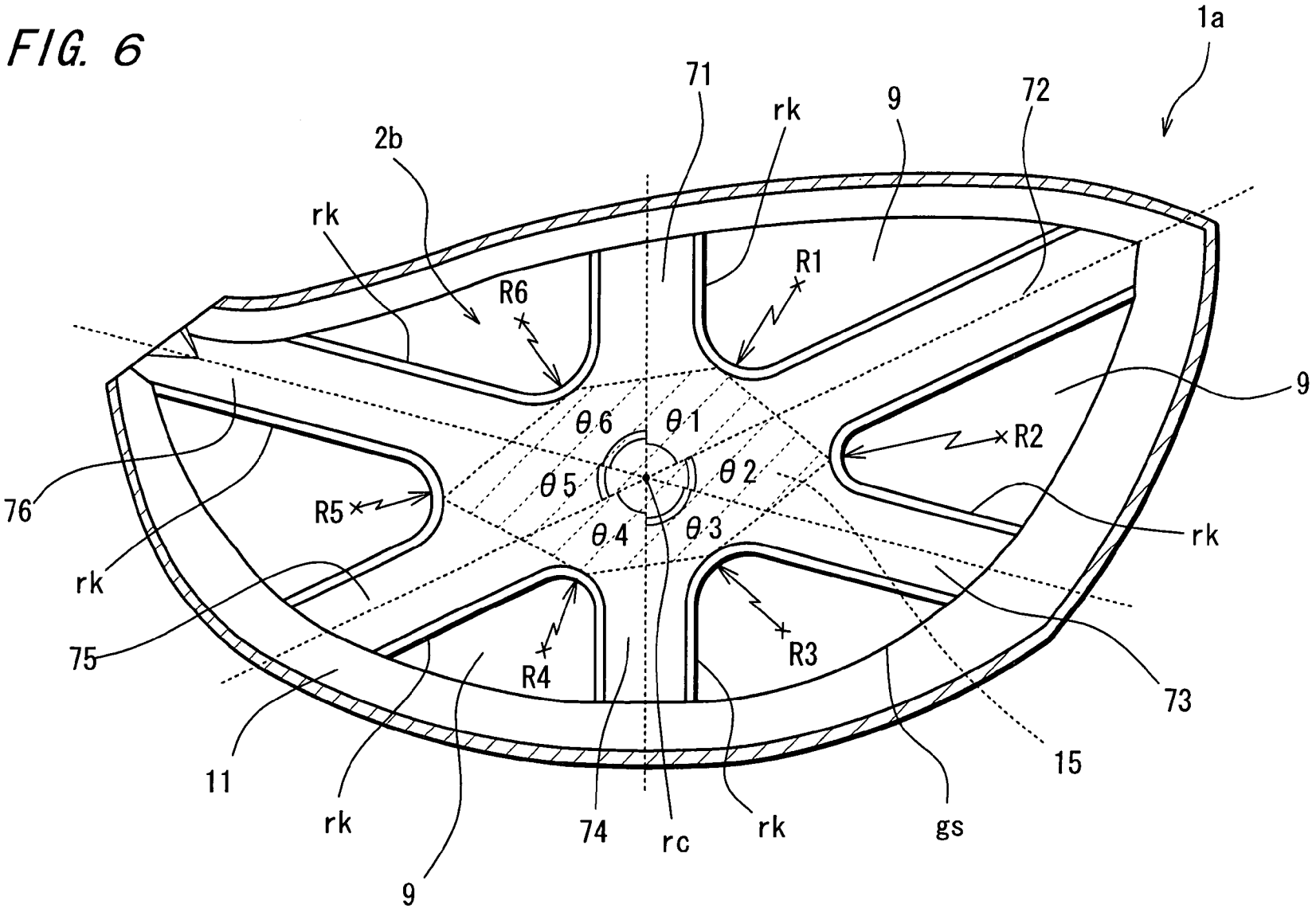
FIG. 6 is a plan view of the same cup-face as that of FIG. 2 as viewed from place opposite the face backside, the plan view being added for the sake of easy view.

FIG. 6 is a plan view of the same cup-face 1*a* as that of FIG. 2 as viewed from place opposite the face backside 2*b*, the plan view being added for the sake of easy view. As shown in FIG. 6, an angle θ1 between the extension directions of the adjoining ribs 71 and 72, for example, is less than 90°, whereas an angle θ2 between the extension directions of the adjoining ribs 72 and 73 is also less than 90°. Likewise, respective angles (θ3, θ4, θ5, θ6) between respective pairs of adjoining ribs (73 and 74, 74 and 75, 75 and 76, 76 and 71) are all less than 90°.

The angles θ1 to θ6 between the extension directions of the respective pairs of adjoining ribs are defined to be less than 90° for the following reason. If there is a region containing any one of the angles θ1 to θ6that is 90° or more, the region tends to suffer the insufficient strength. It is therefore preferred to define the angle to be 80° or less. However, if the angle is too small, the face may be excessively increased in the rigidity at a region containing such a small angle. Thus, the face may be lowered in the restitution performance. Therefore, the angle between the extension directions of the respective pairs of adjoining ribs may preferably be 15° or more, more preferably 30° or more and particularly preferably 40° or more.

The boundary line rk dividing each of the ribs 71 to 76 from the non-rib portion 9 exists on widthwise either side of each rib 71 to 76. Each intersection of the boundary lines rk of adjoining ribs is rounded (chamfered) to impart a roundness of a curvature radius R=1 to 15 mm. Specifically, as shown in FIG. 5, a roundness of a curvature radius R1 (=1 to 15 mm) is imparted to an intersection of the boundary line rk of the rib 71 and the boundary line rk of the rib 72. The curved line of the curvature radius R1 is smoothly continuous to both of the boundary lines rk and is protruded toward a center rc of the rib intersection. Likewise, roundnesses of curvature radii R2, R3, R4, R5 and R6 (each ranging from 1 to 15 mm) are imparted to the respective intersections of the boundary lines rk of the ribs 71 to 76.

Such a configuration improves the durability of the head because the face is increased in the thick area due to the roundnesses imparted to the respective intersections of the boundary lines of the adjoining ribs and because the concentration of stress on the intersections is decreased. The curvature radius R is defined to be 1 mm or more for the following reason. If the curvature radius R is less than 1 mm, the effects to increase the thick area and to reduce the stress concentration are so small that the head may suffer a decreased durability. Therefore, the curvature radius R may more preferably be 2 mm or more. The reason for defining the curvature radius R to be 15 mm or less is as follows. If the curvature radius exceeds 15 mm, the face is increased in the thick area so much as to suffer the decreased restitution coefficient. Therefore, the curvature radius R may more preferably be 14 mm or less, and particularly preferably 12 mm or less.

Figure 7:
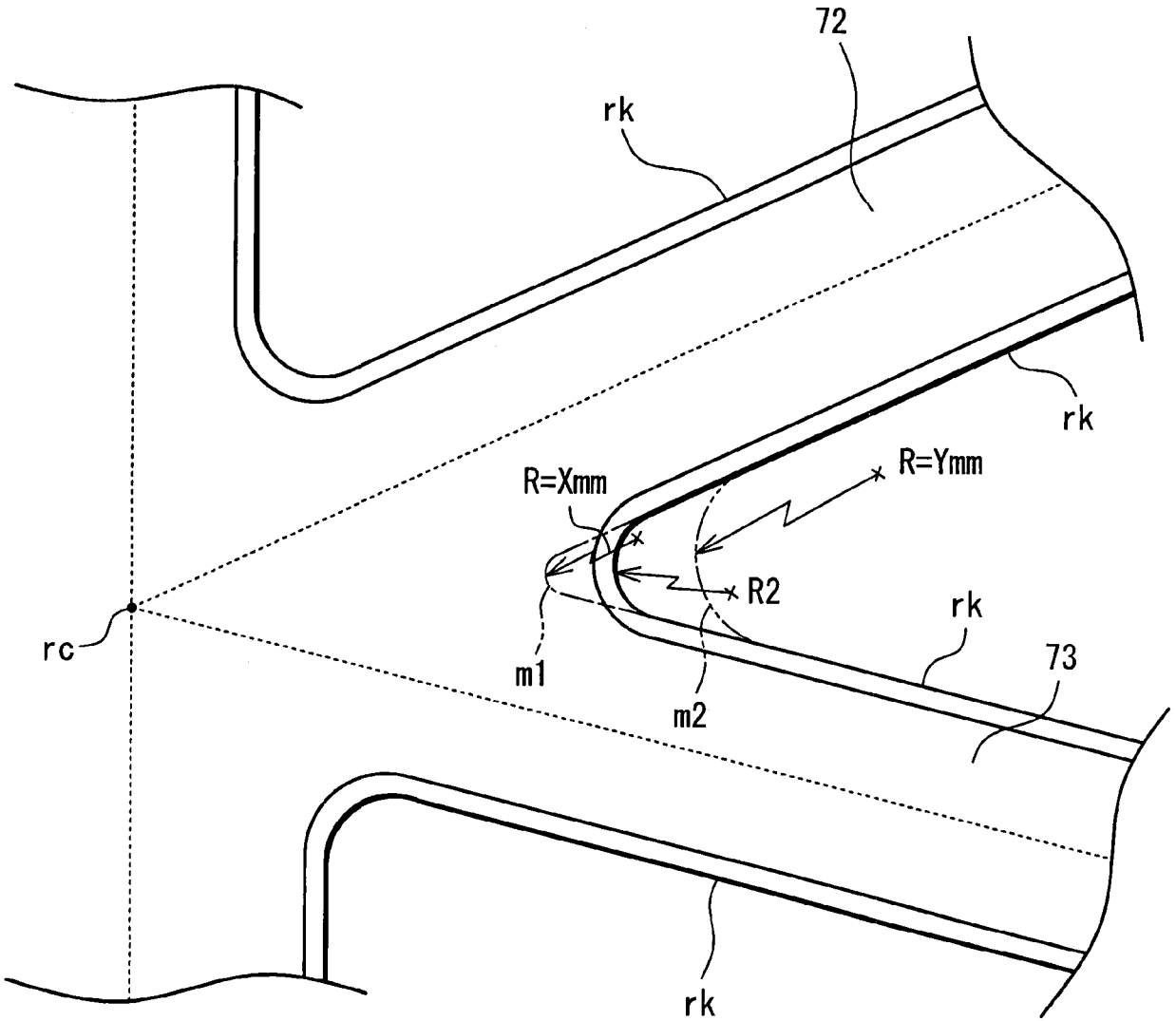
FIG. 7 is an enlarged view showing a region near an intersection of a boundary line rk of a rib 72 and a boundary line rk of a rib 73.

The meanings of "the roundness of the curvature radius R of Xmm or more" and "the roundness of the curvature radius R of Ymm or less" herein are explained by way of example of the adjoining ribs 72 and 73 shown in FIG. 6. FIG. 7 is an enlarged view showing a region near the intersection of the boundary line rk of the rib 72 and the boundary line rk of the rib 73 shown in FIG. 6.

"The roundness of a curvature radius R2 of Xmm or more" means that a curved line of the curvature radius R2 is farther away from the center position rc of the rib intersection than a curved line m1 which is smoothly continuous to both of the boundary lines rk of the ribs 72, 73 intersecting each other, which is protruded toward the center position rc of the rib intersection and which has the curvature radius of Xmm.

"The roundness of the curvature radius R2 of Ymm or less" means that the curved line of the curvature radius R2 is closer to the center position rc of the rib intersection than a curved line m2 which is smoothly continuous to both of the boundary lines rk of the ribs 72, 73 intersecting each other, which is protruded toward the center position rc of the rib intersection and which has the curvature radius of Ymm.

The above roundness need not define an arc having a single curvature radius and may also define a combination of arc portions having different curvature radii. In the case of the roundness defining a combination of arc portions having different curvature radii, it is preferred from viewpoints of durability and restitution that the roundness does not include an arc portion having a curvature radius R of less than 0.5 mm. It is more preferred that the roundness does not include an arc portion having a curvature radius R of less than 1.0 mm. In addition, it is preferred that the roundness does not include an arc portion having a curvature radius R of more than 20 mm. It is more preferred that the roundness does not include an arc portion having a curvature radius R of more than 15 mm. Considering the stress dispersion at the intersection of the boundary lines rk, it is most preferred that the above roundness has a single R (single curvature radius).

The value of a ratio (θ/R) between the above curvature radius R(mm) and the angle θ(°) between the ribs is defined to range from 3 to 50. Specifically, the value (θ1/R1) of a ratio between the above angle θ1(°) and the curvature radius R1 (mm) is defined to range from 3 to 50. Likewise, the respective values of (θ2/R2), (θ3/R3), (θ4/R4), (θ5/R5) and (θ6/R6) are also defined to range from 3 to 50. The reason for defining the value of (θ/R) to be 3 or more is as follows. If the value of the ratio is less than 3, the curvature radius R is excessive relative to the angle θ and hence, the face is excessively increased in the thick area so that the restitution coefficient tends to decrease. Therefore, the value of (θ/R) may more preferably be 6 or more. The reason for defining the value of (θ/R) to be 50 or less is as follows. If the value of the ratio exceeds 50, the curvature radius R is so small relative to the angle θ that the stress tends to concentrate on the intersection of the boundary lines. Hence, the head is prone to decreased durability. Therefore, the value of (θ/R) may more preferably be 22 or less.

It is preferred to define a relationship:

$$R(1) \geqq R(2) \geqq \ldots \geqq R(m) \text{ and } R(1) > R(m), \quad \text{(a)}$$

, provided that the aforesaid plural angles θ are represented by θ(1), θ(2) θ(m) in the descending order of the values thereof, and that an inter-rib curvature radius R with respect to the angle θ(1) is represented by R(1), an inter-rib curvature radius R with respect to the angle θ(2) is represented by R(2), . . . , and an inter-rib curvature radius R with respect to the angle θ(m) is represented by R(m). It is more preferred to define a relationship:

$$R(1) > R(2) > \ldots > R(m). \quad \text{(b)}$$

As described above, it is preferred to limit the value of the ratio (θ/R) to the predetermined range. Therefore, the relation between the curvature radius R and the angle θ may be optimized by defining the magnitude relations between the curvature radii R and the angles θ as illustrated by the above expressions (a) and (b).

It is noted that the individual values of the curvature radii in the above expressions (a) and (b) are expressed in millimeters and are rounded off to the whole numbers.

While the six ribs are provided according to the present embodiment, the number of ribs is defined to be six or more. If the number of ribs is less than six, rib-free regions are so large that the face tends to suffer the insufficient strength at the rib-free regions. However, if the number of ribs is excessive, the face may be excessively increased in the rigidity so that the face may be lowered in the restitution performance. Therefore, the number of ribs extended from the face center toward the circumference of the face may more preferably be 15 or less, even more preferably 10 or less and particularly preferably 8 or less.

According to the head 1 configured as described above, the rigidity at the center of the face portion 2 is locally increased by forming the bulge 8 on the face backside 2*b* and hence, there may be obtained the effect to prevent the restitution coefficient at the center of the face portion 2 from being locally increased. Thus, the change of restitution coefficient may be smoothened from the center of the face portion 2 toward the circumference, so that the restitution coefficients may be relatively evenly distributed across the overall face portion 2. What is more, the other portions than the bulge 8 are reinforced with the plural ribs thereby allowing the face to be formed relatively thin. Thus, the face surface 2*a* as a whole may be improved in the restitution performance. Because of the above features, the face surface 2*a* may attain the relatively high restitution coefficients across a wide area and have the restitution coefficients distributed more evenly than in the conventional face surface. Even when the ball impact point is deviated from the center of the face surface 2*a*, the head may reduce the drop of restitution coefficient. As a result, the head 1 is adapted to exhibit relatively high carry performance in a reliable manner.

According to the present embodiment, the bulge 8 is disposed at place including the sweet spot of the head 1. Thus, the restitution coefficient at the sweet spot, which is particularly apt to be increased, is prevented from being increased. In consequence, the effect to equalize the restitution coefficient may be further enhanced.

According to the present embodiment, the area of the bulge 8 in the face backside 2*b* is defined to range from 2 to 5% based on the overall area of the face backside 2*b*. The reason is as follows. If this area percentage is less than 2%, the restitution coefficient at the center of the face portion 2 may be increased so much that the effect to equalize the restitution coefficient distribution may be lowered. If the above area percentage exceeds 5%, the rigidity of the face portion 2 may be increased so much at the center thereof that the face portion 2 as a whole may be decreased in the restitution coefficient.

The center of a rib convergence portion 15 (the centroid or gravity center of the rib convergence portion 15 represented by hatching) may preferably be located within 4 mm from the center (centroid or gravity center of the face backside 2*b*) of the face backside 2*b*. If the center of the rib convergence portion 15 is located too close to the circumference of the face portion 2, the stress exerted on the face may be less evenly dispersed to the individual ribs. The rib convergence portion 15 means a portion which includes the bulge 8 and is formed at the face center by the plural ribs intersecting one another and which cannot be determined to belong to which of the ribs.

The face thickness (the thickness of the face portion 2) may preferably be 0.5 or more and 6.2 mm or less. The reason for defining the face thickness to be 0.5 mm or more is that the face portion having a thickness of less than 0.5 mm tends to suffer the insufficient strength. The reason for defining the face thickness to be 6.2 mm or less is that the face portion having a thickness of more than 6.2 mm is excessively increased in the rigidity so that the restitution performance is lowered. The face thickness means herein to include thicknesses determined at all the portions of the face backside 2*b*, which include the bulge 8, the ribs 71 to 76 and the non-rib portion 9.

The thickness at the non-rib portion 9, which is free from the rib, may preferably be 3.0 mm or less, more preferably 2.5 mm or less and particularly preferably 2.2 mm or less. The provision of the ribs of the present invention ensures the strength of the face portion 2 although the non-rib portion 9 is reduced in thickness. What is more, it is easier to enhance the restitution performance when the thickness is reduced. It is noted however that if the thickness is reduced too much, the face may suffer the insufficient strength. Therefore, the thickness of the non-rib portion 9 may preferably be 0.4 mm or more, more preferably 0.5 mm or more, even more preferably 0.8 mm or more and particularly preferably 1.4 mm or more.

While the individual ribs 71 to 76 may be extended from the face center toward the face circumference, the ribs 71 to 76 may preferably have their face-center-side ends located within 4 mm from the center of the face backside 2*b* (the unillustrated centroid or gravity center of the face backside 2*b*). If a distance between the face-center-side end of the rib and the center of the face backside 2*b* is increased, the reinforcing effect by way of the ribs may fall short at a region near the face center which is most subjected to the stress. In addition, the ribs may be reduced in ability to evenly disperse the stress on the face center to the face circumference.

Each of the ribs 71 to 76 may preferably be extended to place within 5 mm from a face outside circumference gs (the outside circumference of the face backside 2*b*) It is more preferred that the ribs are extended to the face outside circumference gs. If a distance between the face-circumference-side end of the rib and the face outside circumference gs is increased, the dispersion of the stress on the face center toward the face circumference tends to be limited to a certain range. In addition, the reinforcing effect by way of the ribs may fall short at the face circumference.

The restitution coefficient at the sweet spot of the head 1 may preferably be 0.830 or less. The restitution coefficient is determined according to the Procedure for Measuring the Velocity Ratio of a Club Head for Conformance to Rule 4-1e, Revision 2 (Feb. 8, 1999) published by the U.S.G.A. Hereinafter, the restitution coefficient is also referred to as the restitution coefficient based on the U.S.G.A. system. The reason is that a golf club head having a restitution coefficient exceeding 0.830 based on the U.S.G.A. system is to be regarded as being noncompliant with the Golf Rules on and after Jan. 1, 2008. However, the above restitution coefficient of the head 1 may preferably be 0.800 or more because the head having too low a restitution coefficient based on the U.S.G.A. system is decreased in the carry performance.

While the present invention will be described in more details by way of the examples thereof and comparative examples, it is to be noted that the present invention is not limited to these examples.

EXAMPLES AND COMPARATIVE EXAMPLES

Golf club heads according to the examples of the present invention and those of comparative examples were fabricated and evaluated for verifying the effect of the present invention.

The heads of all the examples conformed to the same specifications except for the thickness distribution of the face portion. In the specifications common to the all examples, a hollow titanium-alloy head was employed which was formed by welding together a cup-face shaped like a cup and a head body, which had substantially the same configurations as those of the foregoing embodiment. The head had a volume of 430 cc and a face area (the area of the face surface) of 4150 $mm^2$.

As the examples, three types of heads having the face portion according to the above embodiment were fabricated (Examples 1 to 3). As the comparative examples, four types of heads in total were fabricated. That is, two types of heads had the same rib layout as that of the heads of Examples 1 to 3 but had different thicknesses at the crest of the bulge (Comparative Examples 1, 2), whereas the other two types of heads had different thickness distributions on the face backside

Comparative Examples 3, 4

In Examples 1 to 3 and Comparative Examples 1 to 2, the non-rib portion as the thinnest part had a thickness of 1.8 mm, while the ribs were laid out and configured in the same way. Although the head of Comparative Example 1 was formed with a protrusion at the face center, the thickness of the protrusion was less than 2.0 times the thickness of the thinnest part. Therefore, the protrusion does not fall under the category of the "bulge" of the present invention. Hence, this head is stated as being free from the bulge in Table 1 to be described hereinlater.

Figure 8:
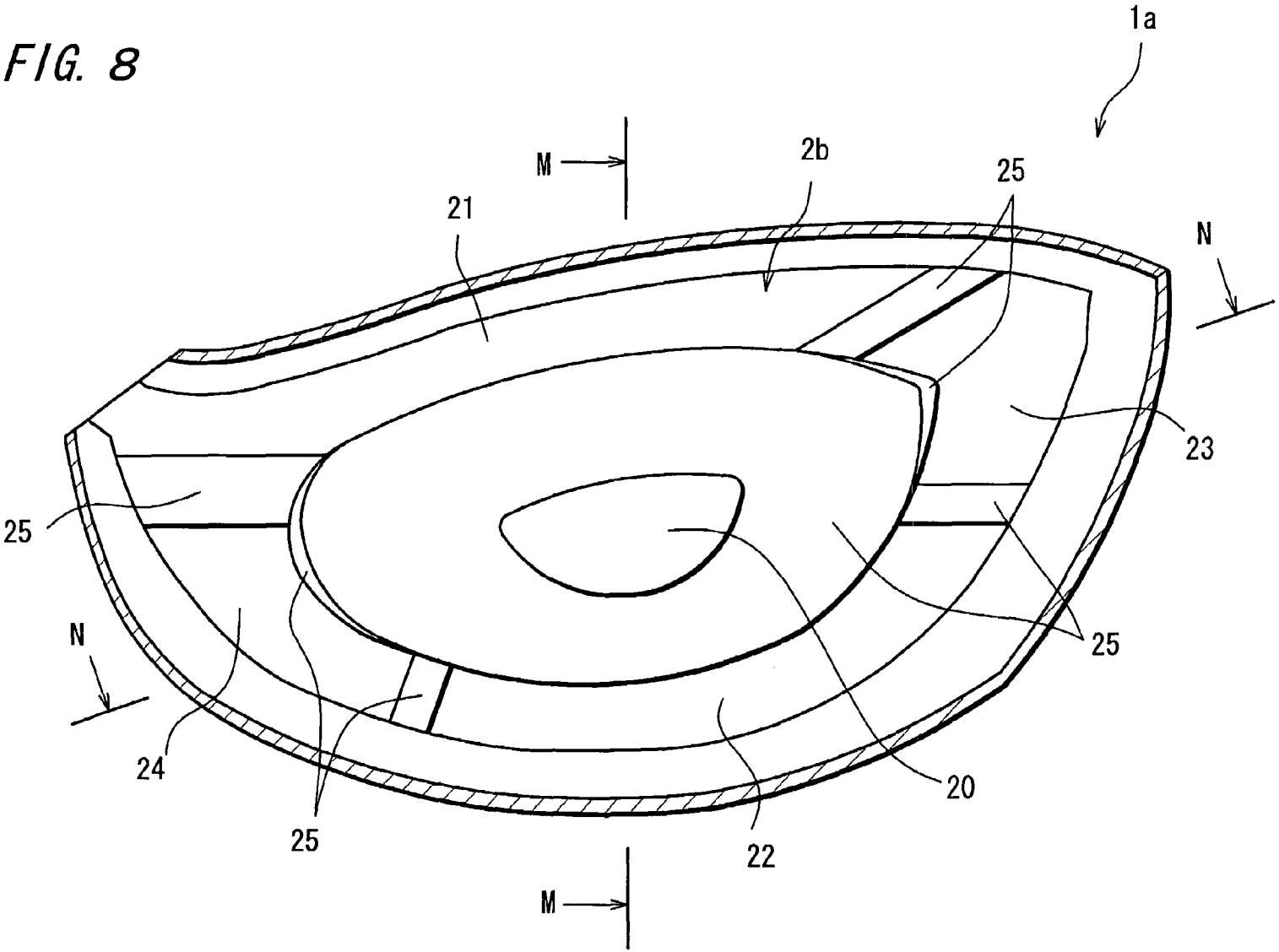
FIG. 8 is a front view showing a face backside of a cup-face of a golf club head according to Comparative Example 3.
Figure 9A:
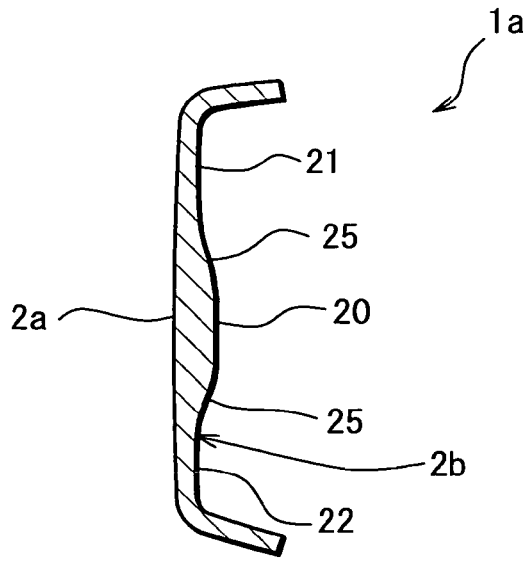
FIG. 9A is a sectional view taken along the line M-M in FIG. 7.
Figure 9B:
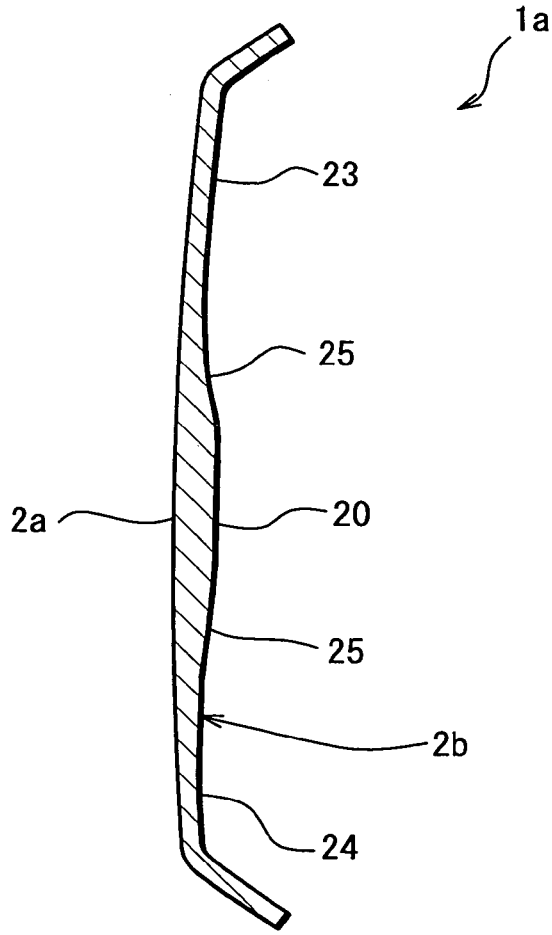
FIG. 9B is a sectional view taken along the line N-N in FIG. 7.

FIG. 8 is a front view showing a face backside of a cup-face of a golf club head according to Comparative Example 3. FIG. 9A is a sectional view taken along the line M-M in FIG. 8, whereas FIG. 9B is a sectional view taken along the line N-N in FIG. 8. As shown in FIG. 8 and FIG. 9, a face portion 2 of Comparative Example 3 had the following thicknesses at individual parts thereof. That is, an elliptical central thicker portion 20 defined in the vicinity of the face center had a thickness of 3.15 mm. Out of the face circumferential portions, an upper circumferential portion 21 on the crown side and a lower circumferential portion 22 on the sole side had a thickness of 2.45 mm, whereas a toe-side circumferential portion 23 and a heel-side circumferential portion 24 had a thickness of 2.2 mm. A transition portion 25 located between the central thicker portion 20 and the face circumferential portions 21 to 24 constituted a slant surface for step-free, smooth connection between the central thicker portion 20 and the face circumferential portions 21 to 24.

Figure 10:
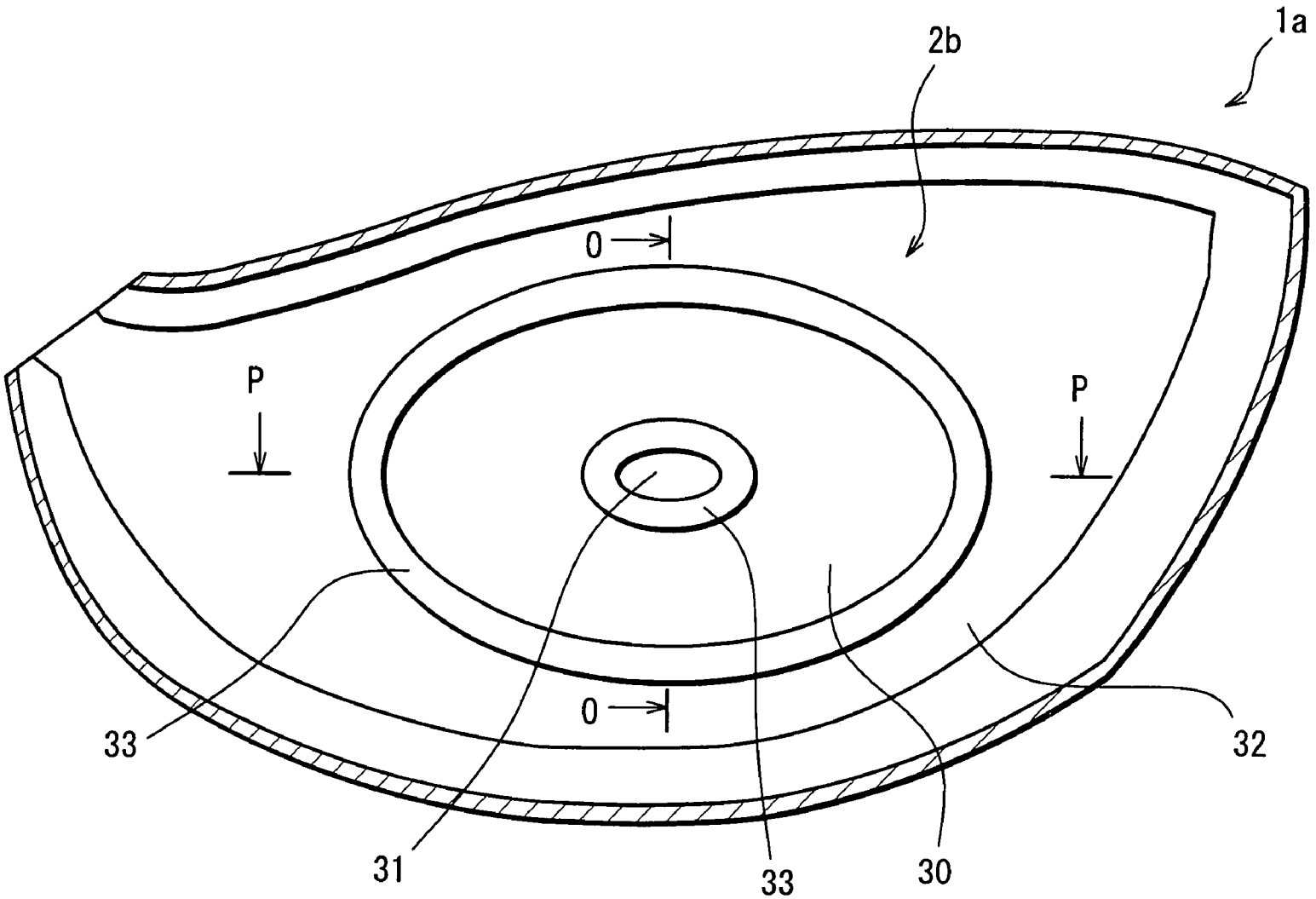
FIG. 10 is a front view showing a face backside of a cup-face of a golf club head according to Comparative Example 4.
Figure 11A:
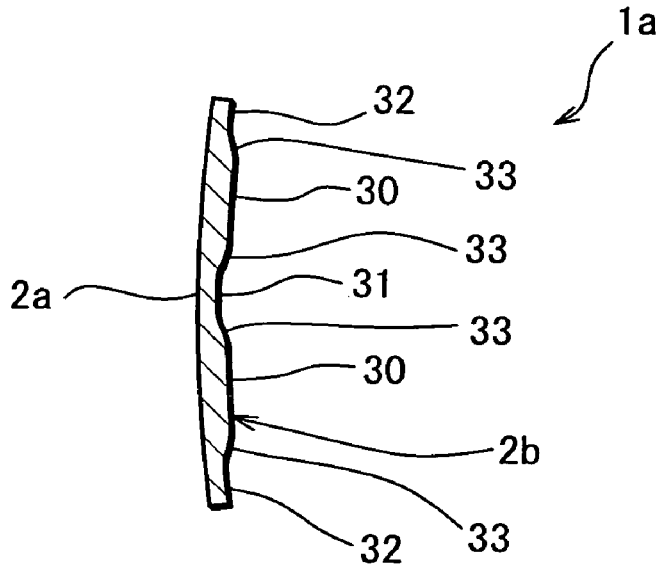
FIG. 11A is a sectional view taken along the line O-O in FIG. 10.
Figure 11B:
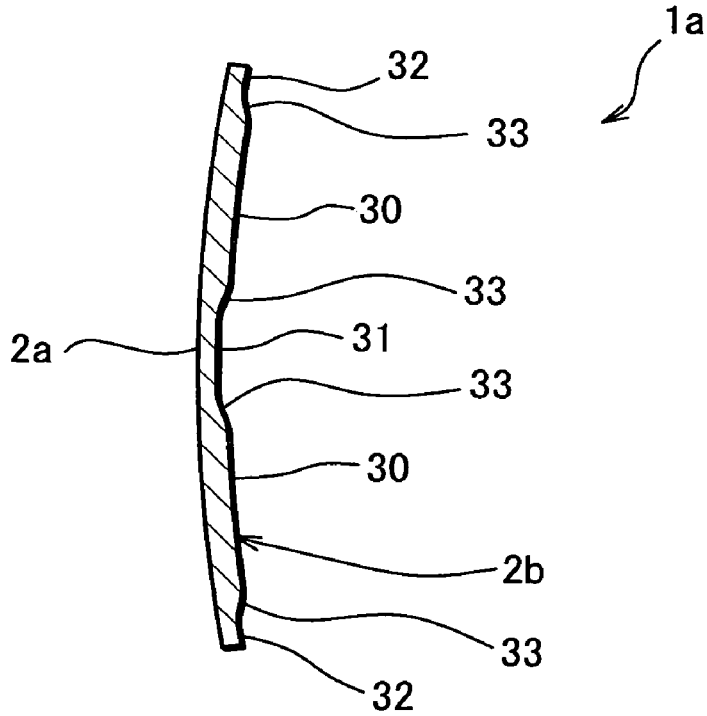
FIG. 11B is a sectional view taken along the line P-P in FIG. 10.

FIG. 10 is a front view showing a face backside of a cup-face of a golf club head according to Comparative Example 4. FIG. 11A is a sectional view taken along the line O-O in FIG. 10, whereas FIG. 11B is a sectional view taken along the line P-P in FIG. 10. As shown in FIG. 10 and FIG. 11, a face portion 2 of Comparative Example 4 included an annular thicker portion 30 which was formed on the face backside in an annular shape and located in the vicinity of the face center. The annular thicker portion 30 had a thickness of 3.1 mm. A central part 31 in the annular thicker portion 30, and a circumferential portion 32 had a thickness of 2.2 mm. A transition portion 33 located between the annular thicker portion 30 and the central part 31, and a transition portion 33 located between the annular thicker portion 30 and the circumferential portion 32 each constitute a slant surface for step-free, smooth connection between the respective portions.

The specifications and evaluation results of the individual examples and comparative examples are listed in Table 1 as below.

TABLE 1

| | | Ex. 1 | Ex. 2 | Ex. 3 | C Ex. 1 | C Ex. 2 | C Ex. 3 | C Ex. 4 |
|---|---|---|---|---|---|---|---|---|
| Spec. | Number of ribs | 6 | 6 | 6 | 6 | 6 | — | — |
| | Rib's cross-sectional area ($mm^2$) | 5.8 | 5.8 | 5.8 | 5.8 | 5.8 | — | — |
| | Rib width (mm) | 10 | 10 | 10 | 10 | 10 | — | — |
| | Rib height (mm) | 1.02 | 1.02 | 1.02 | 1.02 | 1.02 | — | — |
| | Angle between ribs (°) θ1 and θ4 | 65 | 65 | 65 | 65 | 65 | — | — |

TABLE 1-continued

| | | | Ex. 1 | Ex. 2 | Ex. 3 | C Ex. 1 | C Ex. 2 | C Ex. 3 | C Ex. 4 |
|---|---|---|---|---|---|---|---|---|---|
| | | θ2 and θ5 | 40 | 40 | 40 | 40 | 40 | — | — |
| | | θ3 and θ6 | 75 | 75 | 75 | 75 | 75 | — | — |
| | Bulge | Existence | Yes | Yes | Yes | No | Yes | No | No |
| | | Area % based on overall face backside | 3.8 | 4.0 | 3.9 | — | 4.2 | — | — |
| | | Thickness at crest (maximum, mm) | 4.0 | 6.0 | 5.0 | — | 6.5 | — | — |
| | Thickness at thickest part (mm) | | — | — | — | 3.5 | — | 3.15 | 3.1 |
| | Thickness at thinnest part (mm) | | 1.8 | 1.8 | 1.8 | 1.8 | 1.8 | 2.2 | 2.2 |
| | Rate of max. thickness to min. thickness (Max. thickness/min. thickness) | | 2.22 | 3.33 | 2.78 | (1.94) | 3.61 | (1.4) | (1.41) |
| Results | Restitution coefficient | Max. value | 0.829 | 0.8219 | 0.826 | 0.838 | 0.822 | 0.825 | 0.823 |
| | | Min. value | 0.722 | 0.7173 | 0.721 | 0.723 | 0.7052 | 0.7148 | 0.7102 |
| | | Change % of restitution coefficient | 14.82 | 14.58 | 14.56 | 15.91 | 16.56 | 15.42 | 15.88 |
| | Durability | | ○ | ○ | ○ | ○ | ○ | ○ | ○ |

Description is made on the individual items in the table.

The "number of ribs" means the number of ribs extended from the bulge toward the face circumference.

The "rib's cross-sectional area ($mm^2$)" means the mean value of the cross-sectional areas of the rib extended from the bulge to the face circumference.

The definitions of θ1 to θ6 are as shown in FIG. 6 and described in the foregoing.

The "thickness at bulge crest" indicates the maximum thickness of each of the bulges of Examples 1 to 3 and Comparative Example 2.

In Comparative Examples 1, 3, 4 including no bulge, the "thickness at thickest part" indicates the thickness at the thickest part of the face portion.

The "thickness at thinnest part" indicates the thickness of the non-rib portion in Examples 1 to 3 and Comparative Examples 1 and 2. In Comparative Example 3, the "thickness" indicates the thickness of the toe-side and the heel-side circumferential portions 23, 24 which have the smallest thickness (FIG. 8, FIG. 9). In comparative Example 4, the "thickness" indicates the thickness of the central part 31 and the circumferential portion 32 (FIGS. 10, 11) having the smallest thickness.

The "ratio of maximum thickness to thickness of thinnest part" indicates the ratio of the maximum thickness of the bulge to the thickness of the thinnest part in Examples 1 to 3 and Comparative Example 2. In Comparative Examples 1, 3, 4, the "ratio" indicates the ratio of the thickness of the thickest part to the thickness of the thinnest part.

The restitution coefficient was determined using a method analogous to the U.S.G.A. system, Procedure for Measuring Velocity Ratio of a Club Head for Conformance to Rule 4-1e. Specifically, a golf ball was shot by means of a ball shooting machine so as to hit against the face portion of the head at place near each of grid points (points of intersection formed by lines of head longitudinal direction and lines of toe-heel direction in which the lines are drawn in a grid manner at 5 mm intervals with a sweet spot being as a center). The head was not fixed but just placed on a base. The restitution coefficient at each grid point was determined as follows. The ball was shot so as to hit square against the face surface at place within 5 mm from the grid point on the head. The measurement was taken on an incident velocity Vi of the golf ball just before impact on the head and on a bounce-back velocity Vo thereof. Provided that Vi represents the incident velocity of the golf ball, Vo represents the bounce-back velocity thereof, M represents the head mass and m represents the mean mass of the golf ball, the restitution coefficient e at each grid point was calculated based on the following equation:

$$(Vo/Vi)=(eM-m)/(M+m)$$

Incidentally, a distance between a golf-ball shooting aperture and the face portion was set to 1 m. The golf balls used in the measurement test were those of Pinacle Gold Series commercially available from Titleist Inc. The initial ball velocity was set to 48.77 m/s. Seed sensors were set at positions 360.2 mm from the head and 635 mm from the head.

Based on the restitution coefficients e thus determined, a reference point exhibiting the highest restitution coefficient was found in each of the face portions of the examples and comparative examples. The restitution coefficient was determined at each of four points, two of which were 20 mm away from the reference point toward the toe side and the heel side, respectively. The other two points were 10 mm away from the reference point in an upward direction and in a downward direction, respectively. Of the restitution coefficients e determined at these four points, the smallest value was defined as the minimum value of the restitution coefficient while the restitution coefficient e at the reference point was defined as the maximum value. The percentage of change of restitution coefficient was calculated based on the following equation:

Restitution-coefficient change percentage=((Maximum restitution coefficient $e$−Minimum restitution coefficient $e$)/Minimum restitution coefficient $e$)×100.

The restitution-coefficient change percentages of the examples and comparative examples were compared.

In a head having a smaller value of the restitution-coefficient change percentage than the other heads, the difference between the highest restitution coefficient and the restitution coefficient determined at the peripheral portion about the point exhibiting the highest restitution coefficient is decreased. Therefore, the head may be said to achieve a more even distribution of restitution coefficients across a greater area.

The "durability" was evaluated as follows. A golf club was fabricated by assembling a shaft and a grip to the head of each of the examples. The resultant golf club was attached to a swing robot to hit 1000 balls at a head speed of 50 m/s. The robot was adjusted to hit the ball at the face center as the ball impact point. The face surfaces of the heads were examined for dents produced by the impact with the balls. A head sustaining a dent of a depth of 0.1 mm or less was rated as ○, whereas a head sustaining a dent of a depth of more than 0.1 mm was rated as Δ. A head sustaining face surface failure before hitting 1000 balls was rated as X.

As shown in Table 1, the results of the evaluation test on the examples and comparative examples indicate that the restitution-coefficient change percentages of all the examples are smaller than those of the comparative examples.

It is thus verified from the above results that the invention provides the golf club head which achieves the high restitution coefficients distributed more evenly across the wider area of the face surface, so as to reduce the drop of restitution coefficient even when the ball impact point is deviated from the face center.

What is claimed is:

1. A golf club head comprising a face which includes a bulge formed at the center of a backside thereof and having a thickness of 2.0 or more times the thickness of the thinnest part, and a plurality of ribs extended from the bulge toward a circumference of the face, wherein six or more ribs we provided as the plural ribs and an angle θ(°) formed between extension directions of a respective pair of adjoining ribs is less than 90°, wherein the maximum thickness of the bulge is not more than 3.5 times the thickness of the thinnest part, and wherein the bulge is disposed at a place including a sweet spot and has an area percentage of 2 to 5% based on the overall area of the face backside.

2. A golf club head according to claim 1, wherein a cross-sectional area of a rib is in the range of 2.0 to 10.0 $mm^2$.

3. A golf club head according to claim 2, wherein a width of a rib is in the range of 3 to 14 mm whereas a height of a rib is in the range of 0.3 to 1.5 mm.

4. A golf club head according to claim 3, wherein a thickness of the face is in the range of 0.5 to 6.2 mm.

5. A golf club head according to claim 2, wherein a thickness of the face is in the range of 0.5 to 6.2 mm.

6. A golf club head according to claim 1, wherein a thickness of the face is in the range of 0.5 to 6.2 mm.

7. A golf club head, comprising a face which includes a bulge formed at the center of a backside thereof and having a thickness of 2.0 or more times the thickness of the thinnest part, and a plurality of a ribs extended from the bulge toward a circumference of the face, wherein six or more ribs are provided as the plural ribs and an angle θ(°) formed between extension directions of a respective pair of adjoining ribs is less than 90°, wherein the maximum thickness of the bulge is not more than 3.5 times the thickness of the thinnest part, wherein the bulge is disposed at a place including a sweet spot and has an area percentage of 2 to 5% based on the overall area of the face backside, and wherein a width of a rib is in the range of 3 to 14 mm whereas a height of a rib is in the range of 0.3 to 1.5 mm.

8. A golf club head according to claim 7, wherein a thickness of the face is in the range of 0.5 to 6.2 mm.

9. A golf club head, comprising a face which includes a bulge formed at the center of a backside thereof and having a thickness of 2.0 or more times the thickness of the thinnest part, and a plurality of ribs extended from the bulge toward a circumference of the face, wherein six or more ribs are provided as the plural ribs and an angle θ(°) formed between extension directions of a respective air of adjoining ribs is less than 90°, wherein the maximum thickness of the bulge is not more than 3.5 times the thickness of the thinnest part, wherein the bulge is disposed at a place including a sweet spot and has an area percentage of 2 to 5% based on the overall area of the face backside, and wherein a value given by dividing a rib height by a rib width [(rib height)/(rib width)] is 0.05 or more and 0.20 or less.

10. A golf club head, comprising a face which includes a bulge formed at the center of a backside thereof and having a thickness of 2.0 or more times the thickness of the thinnest part, and a plurality of ribs extended from the bulge toward a circumference of the face, wherein six or more ribs are provided as the plural ribs and an angle θ(°) formed between extension directions of a respective pair of adjoining ribs is less than 90°, wherein the maximum thickness of the bulge is not more than 3.5 times the thickness of the thinnest part, wherein the bulge is disposed at a place including a sweet spot and has an area percentage of 2 to 5% based on the overall area of the face backside, and wherein boundary lines dividing each of the ribs from non-rib portions exist on widthwise either side of each rib, and each intersection of the boundary lines of adjoining ribs is rounded to impart a roundness of a curvature radius R=1 to 15 mm.

11. A golf club head, comprising a face which includes a bulge formed at the center of a backside thereof and having a thickness of 2.0 or more times the thickness of the thinnest part, and a plurality of ribs extended from the bulge toward a circumference of the face, wherein six or more ribs are provided as the plural ribs and an angle θ(°) formed between extension directions of a respective pair of adjoining ribs is less than 90°, wherein the maximum thickness of the bulge is not more than 3.5 times the thickness of the thinnest part, wherein the bulge is disposed at a place including a sweet spot and has an area percentage of 2 to 5% based on the overall area of the face backside, and wherein boundary lines dividing each of the ribs from non-rib portions exist on widthwise either side of each rib, and each intersection of the boundary lines of adjoining ribs is rounded to impart a roundness of a curvature radius R, and wherein a value of a ratio (θ/R) between the curvature radius R(mm) and an angle θ(°) between the adjoining ribs is defined to range from 3 to 50.

12. A golf club head, comprising a face which includes bulge formed at the center of a backside thereof and having a thickness of 2.0 or more times the thickness of the thinnest part, and a plurality of ribs extended from the bulge toward a circumference of the face, wherein six or more ribs are provided as the plural ribs and an angle θ(°) formed between extension directions of a respective pair of adjoining ribs is less than 90°, wherein the maximum thickness of the bulge is not more than 3.5 times the thickness of the thinnest part, wherein the bulge is disposed at a place including a sweet spot and has an area percentage of 2 to 5% based on the overall area of the face backside, and wherein boundary lines dividing each of the ribs from non-rib portions exist on widthwise either side of each rib, and each intersection of the boundary lines of adjoining ribs is rounded to impart a roundness of a curvature radius R, and wherein relationships $R(1) \geqq R2 \geqq \ldots \geqq R(m)$ and $R(1) \geqq R(m)$ are satisfied, provided that plural angles θ, each of angles θ being defined by respective pair of adjoining ribs, are represented by θ(1), θ(2), . . . , θ(m) in the descending order of the values thereof, that an inter-rib curvature radius R with respect to the angle θ(1) is represented by R(1), that an inter-rib curvature radius R with respect to the angle θ(2) is represented by R(2), . . . , and that an inter-rib curvature radius R with respect to the angle θ(m) is represented by R(m).

13. A golf club head comprising a face which includes a bulge formed at the center of a backside thereof a plurality of ribs extended from the bulge toward a circumference of the face, and non-rib portions each being arranged between adjacent ribs and each having a thickness smaller than that of the bulge and that of a rib, wherein six or more ribs are provided as the plural ribs and an angle θ(°) formed between extension directions of a respective pair of adjoining ribs is less than 90°; and wherein boundary lines dividing each of the ribs from non-rib portions exist on widthwise either side of each rib, and each intersection of the boundary lines of adjoining ribs is rounded to impart a roundness of a curvature radius R=1 to 15 mm.

* * * * *